United States Patent [19]

Cottam

[11] 4,069,088

[45] Jan. 17, 1978

[54] PIPE WRAPPING APPARATUS

[75] Inventor: Spencer D. Cottam, Harris County, Tex.

[73] Assignee: Midcon Pipeline Equipment Co., Houston, Tex.

[21] Appl. No.: 743,699

[22] Filed: Nov. 22, 1976

[51] Int. Cl.[2] ..... B65H 81/00; D02G 3/36; B65H 75/18

[52] U.S. Cl. ..... 156/392; 57/13; 156/443; 242/7.23; 242/72 R; 242/75.4; 242/156

[58] Field of Search ..... 156/392, 443, 187, 188; 242/156, 68.3, 71.8, 71.9, 75.4, 72 R, 7.23; 57/10, 13

[56] References Cited

U.S. PATENT DOCUMENTS

| | | | |
|---|---|---|---|
| 447,496 | 3/1891 | Slade | 242/156 |
| 722,159 | 3/1903 | Stephenson | 242/72 |
| 2,019,518 | 11/1935 | Widell | 242/75.4 |
| 2,344,264 | 3/1944 | Perrault | 156/392 |
| 3,221,401 | 12/1965 | Scott et al. | 242/7.23 |
| 3,470,057 | 9/1969 | Sturt, Jr. et al. | 156/392 |
| 4,008,114 | 2/1977 | Lindsey | 156/392 |

*Primary Examiner*—Douglas J. Drummond
*Attorney, Agent, or Firm*—Carl B. Fox, Jr.

[57] ABSTRACT

Pipe wrapping apparatus of the so-called hand-wrapping type, having a rotating ring structure which carries spindle apparatuses, each carrying a roll of pipe wrapping tape. The apparatus includes take up spindles for accumulation of the backing stripped from tapes which have backing, and includes brake devices for controlling the tension at which the tape is wound onto the pipe. While the apparatus is of the so-called hand-wrapping type, it may be power driven. The apparatus also provides for applying a coat of primer or other precoating material onto the pipe prior to the application of the tape. A notable feature of the invention is the provision of self-balancing spindles through the use of which the tape is consistently applied to the pipe without wrinkles or other misalignments of the tape and with uniform overlap of courses.

47 Claims, 8 Drawing Figures

26
40
65
32
28
30
33
31
24
23
15
16
19
21
92
140
137
136
135
147
146
148
150
88
61
161
160
17
162
151
166
115
120
86
97
111
110
119
170
171
138
104
176
85
108
173
117
165
118
109
60
114
124
133
87a
87
156
22
155
154
91
141
157
153
158
133
65
32
24
33
31
28
30
40
26

PIPE WRAPPING APPARATUS

BACKGROUND OF THE INVENTION

Prior pipe wrapping apparatuses of the hand-wrapping type have been relatively slow in operation and difficult to control. These apparatuses, although referred to as hand-wrapping apparatuses, have been fairly heavy and not really movable by hand for use in wrapping pipes. The older apparatuses have in general not made provision for taking up the backing strip from the tape before the tape is wrapped on the pipe, in such cases where a backing was provided on the tape. The older apparatuses have required careful adjustment of the spindle angles in order to achieve flat wrapping of the tape onto the pipe. The older apparatuses further have not provided means for application of precoat or priming material to the pipe prior to wrapping. While some of the older apparatuses have been adaptable to wrapping of plural pipe sizes, none has been so easily adjustable for this purpose as the present apparatus.

SUMMARY OF THE INVENTION

The invention provides a pipe wrapping apparatus of the hand-wrapping type which is smaller and lighter in weight than conventional apparatuses. The apparatus includes tape spindles which are self-adjusting as to angularity whereby the tape is applied to the pipe in flat condition automatically which results in application of the tape without wrinkling or misalignments and which also results in uniformity of laps of succeeding courses of tape around the pipe. The self-adjusting spindles are pivotally mounted at the center of the tape roll so that the tape tension itself aligns the spindle. The apparatus may be driven by hydraulic or other motors, yet are still hand operated in the sense that they do not require a heavy and complicated conveyance for movement of the apparatus along the pipe. The apparatus is sufficiently light in weight that in most cases two workmen will be able to lift and place the apparatus upon the pipe and to remove the apparatus from the pipe once the work is completed. The apparatus includes means for applying a layer of coating or priming material to the pipe prior to wrapping. Provision is included for leveling the apparatus on the pipe by hand so that apparatus rotation caused by the tape tension may be readily prevented.

A principal object of the invention is to provide a pipe-wrapping apparatus of the so-called hand wrapping type. Another object of the invention is to provide such apparatus which is of small size and is light in weight, yet is entirely reliable and dependable in operation. A further object of the invention is to provide such apparatus which includes tape spindles which are automatically adjusted in angularity so as to apply the tape flatly and evenly to the pipe. Another object of the invention is to provide such apparatus having means for accumulation of backing stripped from the tape. Yet another object of the invention is to provide such apparatus which includes provision for applying a coating or priming layer to the pipe prior to wrapping. Still another object of the invention is to provide such apparatus which is adjustable for use in connection with pipes of different sizes.

Other objects and advantages of the apparatus afforded by the invention will appear from the following detailed description of preferred embodiments thereof, reference being made to the accompanying drawings.

BRIEF DESCRIPTIONS OF THE DRAWINGS

DESCRIPTION OF THE PREFERRED EMBODIMENT

Figure 1:
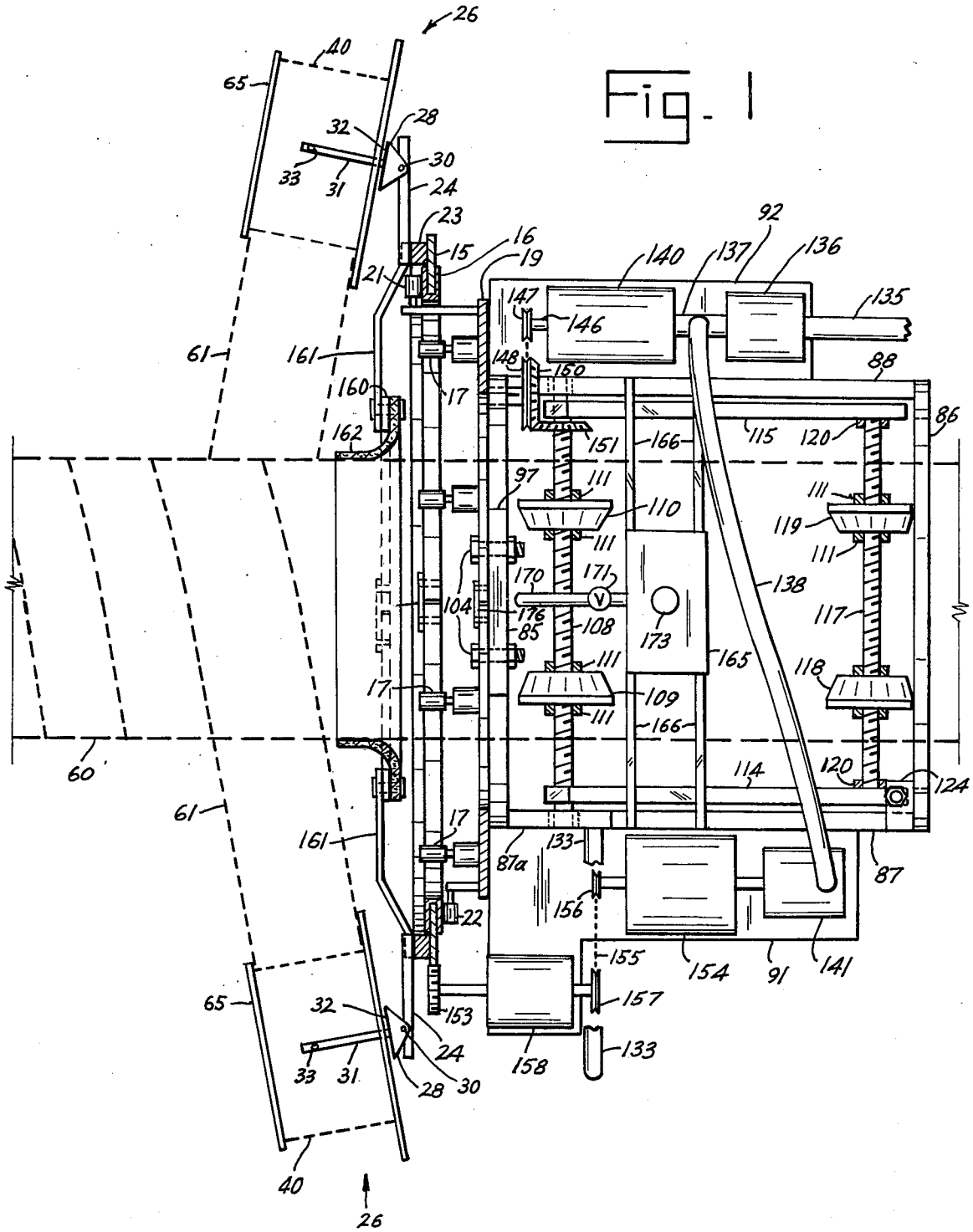
FIG. 1 is a plan view, partly in horizontal cross section and partly schematic, showing a preferred embodiment of apparatus according to the invention.

Referring now to the drawings in detail, and primarily first to FIG. 1 of the drawings, the apparatus includes a circular ring gear 15 mounted in the peripheral slot of a rotative support ring 16. Gear 15 and ring 16 are supported by plural circularly spaced rollers 17 mounted on a stationary ring 19 and which engage the inner periphery of ring 16. Upper roller 21 and lower roller 22 are disposed against opposite sides of ring 16 to prevent tilting of ring 16 due to the weight of the spindle apparatus, tape rolls, and tape tension to be described. Another ring 23 is carried by gear 15 and has two radially outwardly extending bars 24 depending oppositely therefrom.

In FIG. 1 and also in the other drawings, some of the means for connection of the elements together are omitted or incompletely shown, but it will be apparent to those skilled in the art as to how the connections are or could be made.

Figure 2:
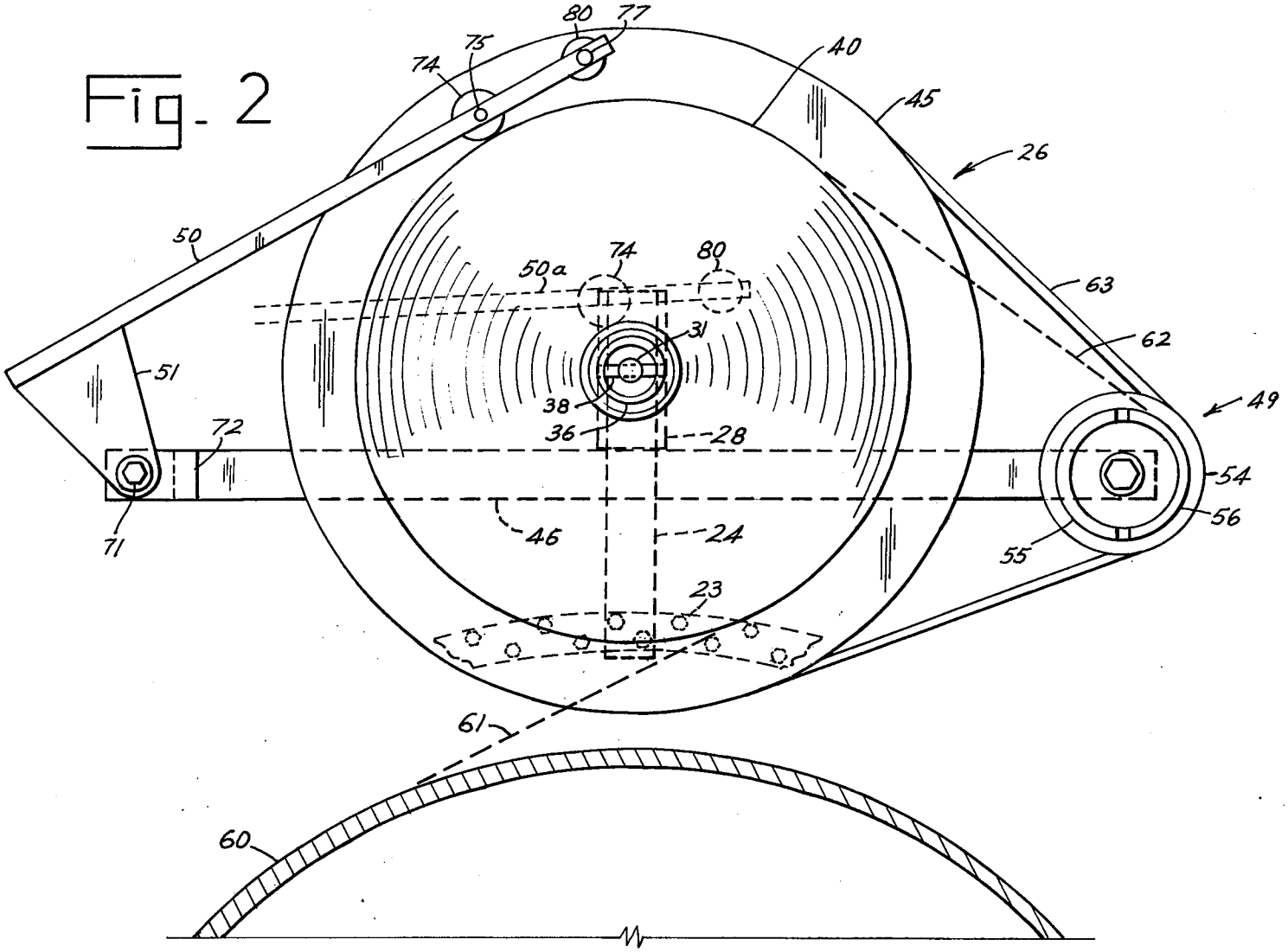
FIG. 2 is a side elevation showing a spindle apparatus according to the invention.
Figure 3:
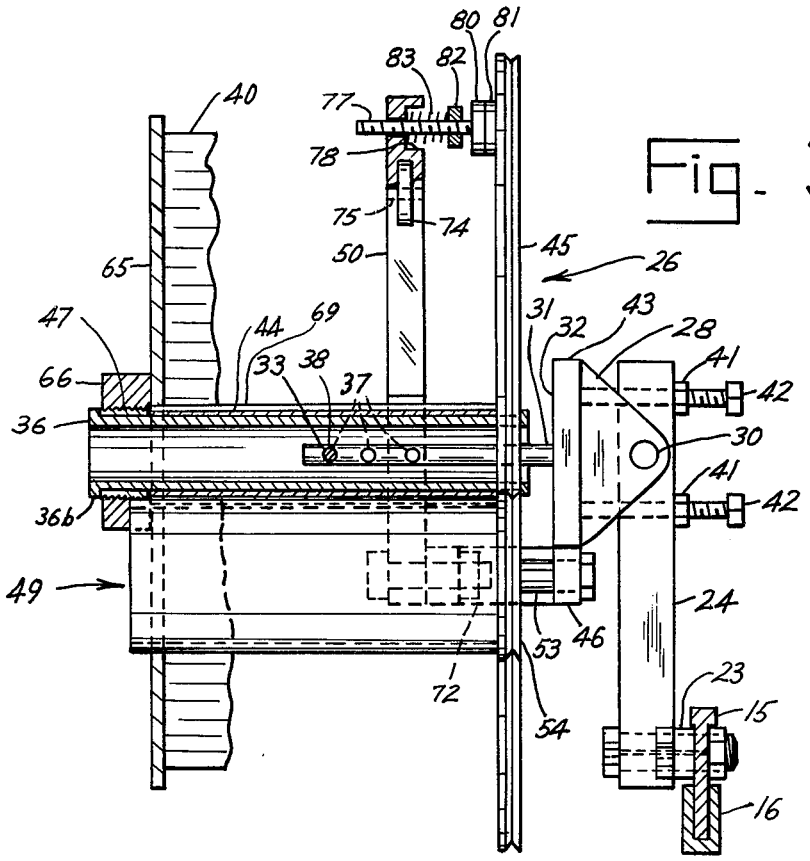
FIG. 3 is a side elevation, partly in axial cross section, of the spindle apparatus shown in FIG. 2.

A spindle assembly 26 as shown in FIGS. 2 and 3 is supported at the outer end of each bar 24, the spindle assemblies being indicated schematically in FIG. 1. Each spindle assembly 26 is supported on a bar 24 by a yoke member 28 pivotally connected to bar 24 by a pin or bolt 30. A shaft 31 extends from the face 32 of each yoke 28 and has a hole 33 therethrough near its outer end.

Referring now to FIGS. 2 and 3, a spindle shaft 36, in the form of a cylindrical tube or pipe, has diametrically opposite pairs of axially spaced holes 37 through its wall through which a pin 38 may be inserted, the pin passing also through hole 33 of shaft 31. The holes 37 at each side of tubular shaft 36 are positioned to be at the axial centers of rolls of tape of different widths. In FIG. 3, the pin 38 is disposed through hole 33 of shaft 31 and through the outermost of the holes 37 of tubular shaft 36, and is at the axial center of the roll of tape 40 shown in use. For tape rolls of lesser widths, the pin will be disposed through a more inwardly disposed hole 37 at the center of the width of the roll.

The spindle, pivotally mounted in this manner, is free to rotate to a limited extent about the pin 38. The tape extends from the spindle in the manner illustrated in FIG. 1, and the tape tension as ring 16 is rotated about the pipe causes the spindle angularity to adjust so that the tape leaves the spindle in a straight and flat path. This eliminates the necessity for tedious adjustment of the spindle angularity. Of course, the angularity of shaft 31 is initially adjusted by positioning yoke 28 to a position nearly correct for the spindle angularity. This is accomplished by loosening lock nuts 41 and adjusting the extents by which screws 42 extend through tapped openings through bar 24 and against yoke plate 43. Thus, the yoke 28 as shown in FIG. 1 is adjusted to an approximately correct angle for the spindle in advance, but minor adjustments of the spindle angularity are automatically taken care by the pivotal mounting of the spindle.

Figure 4:
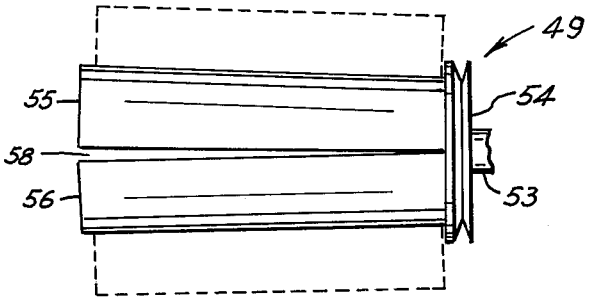
FIGS. 4 and 5 are partial views showing the backing up spindle structures according to the invention.
Figure 5:
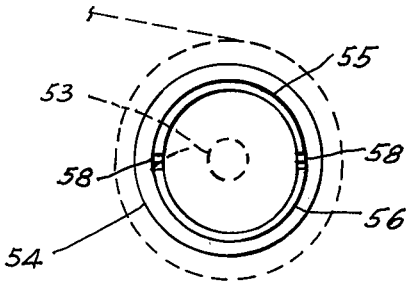

At the inner end of spindle shaft 36, a large diameter relatively thin flat sheave or pulley plate 45 is concentrically journaled therearound against shoulder 36*a*. A spindle sleeve 44 is rotatively disposed around shaft 36, its inner end being welded or otherwise affixed to sheave plate 45. Plural longitudinal bars 69 are disposed circularly spaced around sleeve 44, and an outwardly threaded ring 47 is affixed to sleeve 44 at its outer end, held on shaft 36 by enlarged end 36*b*. Sheave plate 45, sleeve 44, bars 69 and ring 47 are rotatably disposed as a unit around shaft 36. A cross bar 46 is affixed to the inner side of yoke plate 43. A take-up spindle 49 is carried at one end of bar 46, and a brake bar 50 having bracket 51 is pivotally connected to the other end of bar 46. Take-up spindle 49 is shown in FIGS. 4 and 5. The spindle is supported by a shaft 53 supported for rotation through the center of bar 46. A pulley or sheave 54 forms the spindle end, and the opposite portion of the spindle is formed by two half-cylindrical pipe sections 55, 56. The half pipe sections 55, 56 may be made by sawing or otherwise cutting opposite slots lengthwise of a length of pipe, and then mounting the half pipe sections to sheave 54 with an angular opening therebetween at each side, the openings being referred to by reference numeral 58. If the roll of tape 40 has backing at the outer side of the tape, an initial length of the backing may be drawn from the tape and drawn around spindle 49 and into one of the slots 58. As the tape is unwound from roll 40 and applied to a pipe 60 along path 61, the backing is continuously withdrawn from the back side of the tape along path 62 and wound onto take-up spindle 49.

The split form of the take-up spindle 49 serves to hold the backing wound thereon accidentally falling off of the spindle because of the enlargement of the spindle toward its forward end, and no disc or plate need be provided for this purpose. After the take-up spindle has been filled to capacity with backing, the roll of backing may be easily removed by engaging the spindle halves by a suitable tool and squeezing the spindle halves together to cylindrical form so that the roll of backing will be loosened and will easily slide from the end of the spindle.

Figure 8:
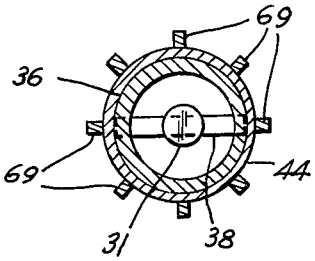
FIG. 8 is a transverse cross section of a tape spindle according to the invention.

The take-up spindle 49 is rotated by a belt 63 disposed around sheaves 45 and 54 (FIG. 2). As ring 16 is rotated in in the proper direction around pipe 60, sheave plate 45 and the associated tape spindle are rotated as the tape is drawn from the roll and this rotation through belt 63 causes rotation of take-up spindle 49. The tape spindle including sheave plate 45 is in planetary rotation about the pipe 60. The tape roll 40 is held on the tape spindle by a plate 65 and ring nut 66 screwed onto the threads of ring 47. In the case of a roll 40 of lesser width, a spacer pipe of suitable length will be disposed between nut 66 and plate 65 in order that the plate 65 will be disposed against the outer side of the tape roll. The spacer pipe is not shown in the drawings, but simply amounts to a length of pipe disposed between plate 65 and nut 66 as described to properly position plate 65 against the tape roll. As is also shown in FIG. 8 of the drawings, sleeve 44 of the tape spindle has longitudinal ribs 69 circularly spaced there-around in order to provide friction between the central core of the tape roll and the sleeve. Sleeve 44 may be made of a suitable bearing material in order to reduce friction between the sleeve and shaft 36. Sleeve 44 may be in the form of axially spaced rings instead of in the continuous form shown.

Referring primarily to FIG. 2 of the drawings, the brake bar 50 having bracket 51 at one end thereof is pivotally mounted at bolt or pin 71 to the outer left hand end of bar 46 as shown in FIG. 2. Bar 46 is laterally offset at 72. A wheel 74 carried on shaft 75 is disposed through a slot opening through bar 50, wheel 74 being positioned to roll against the outer surface of the tape roll 40. The wheel 74 may be omitted, in which case the side of bar 50 would slidingly engage the outer surface of the tape roll. At the end of bar 50 opposite bracket 51, a threaded brake shaft 77 is disposed through a cylindrical opening through bar 50, bar 50 having a concentric circular recess 78 at its side toward sheave plate 45. A brake disc 80 having brake linig 81 affixed to its side against sheave plate 45 is carried at the end of shaft 77. An adjustment nut 82 is screwed onto brake shaft 77 and a compression spring 83 is disposed with one of its ends within recess 78 and its other end against adjustment nut 82. The compression of spring 83 may be adjusted by movement of nut 82 along shaft 77 to adjust the force of brake lining 81 exerted against sheave plate 45. The brake pressure determines the tension of the tape withdrawn from roll 40 and wrapped about the pipe. The brake bar 50 is held against outward movement when the spindle rotates because of the fact that the brake drag on sheave plate 45 tends to draw the bar inwardly toward the roll. For this purpose, the brake disc 80 must be positioned beyond a radius of the tape roll and spindle perpendicular to bar 50 from the bracket end 51 of bar 50. Upon rotation of sheave plate 45, the rotation tends to draw bar 50 inwardly against the tape roll. Therefore, no spring or biasing device for bar 50 is required. As the diameter of the tape roll decreases, bar 50 will be moved inwardly toward a position 50*a*, wheel 74 or the inner side of bar 50 if wheel 74 is not provided still being disposed against the outer circumference of the tape roll.

Figure 6:
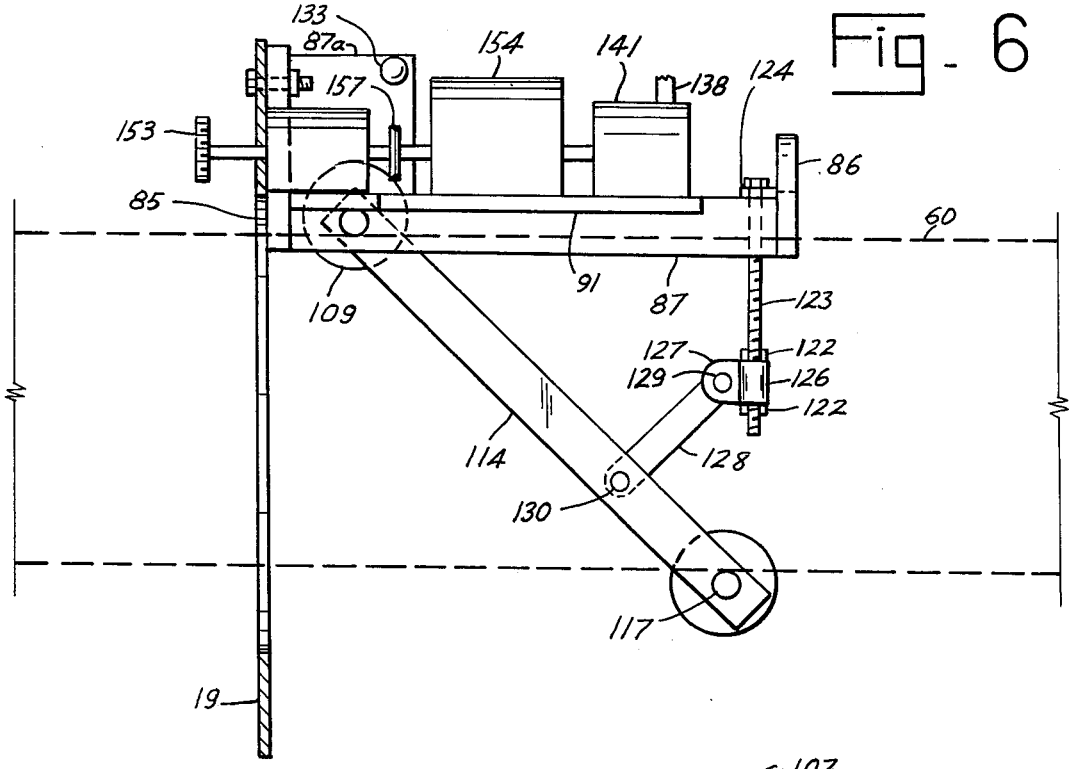
FIG. 6 is a side elevation showing the drive and support assembly for the apparatus.
Figure 7:
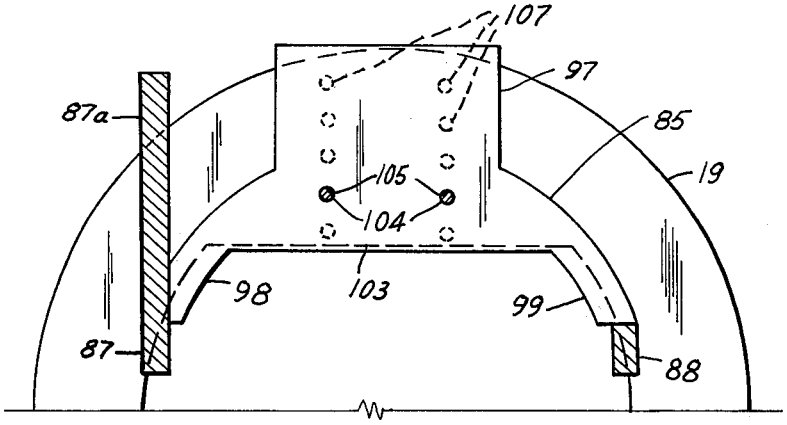
FIG. 7 is a partial elevation illustrating the manner of pipe size adjustment according to the invention.

Referring now primarily to FIGS. 1, 6 and 7 of the drawings, a carriage frame is made up of end members 85, 86 and side members 87, 88. A horizontal platform 91 is welded to member 87 and a horizontal platform 92 is welded to member 88.

Member 85 has an upstanding rectangular portion 97 and arcuate side portions 98, 99 as shown in FIG. 7. Support ring 19 is of circular ring form at its bottom and sides and is inwardly thickened at 103 at its upper side the bottom edge of which is disposed along a cord of the ring formation. Ring 19 supports rollers 17, 21, 22 which support ring 16, and must be concentric with the pipe being wrapped when the apparatus is in use. Portion 97 of member 85 is affixed to ring 19 by a pair of bolts 104. Portion 97 has a pair of horizontally spaced bolt holes 105 which may be aligned with any pair of plural vertically spaced bolt holes 107 at the upper side of ring 19. By proper location and selection of the bolt holes 105 and 107, in which the bolts 104 are disposed, member 85 may be positioned properly with respect to a pipe to be wrapped while ring 19 is concentric with such pipe.

A threaded shaft 108 has a pair of wheels 109, 110, disposed therearound, the wheels being internally threaded and locked in place by lock nuts 111. The wheels 109, 110, therefore, may be moved axially with respect to shaft 108 to properly position the wheels against a pipe of any size. The wheels rotate with shaft 108 which is journaled for rotation at its ends at members 87, 88.

A pair of wheel support arms 114, 115 are pivotally supported around the ends of shaft 108. The ends of shaft 108 are journaled in members 87, 88 as shown in FIG. 1 and arms 114, 115 may pivot around shaft 108. At their opposite ends, bars 114, 115 have journaled for rotation therebetween a shaft 117 carrying wheels 118, 119 mounted thereon in the same manner that wheels 109, 110 are mounted on shaft 108. Wheels 118, 119 are movable longitudinally of shaft 117 in the manner heretofore described. By loosening of nuts 120 shaft 117 may be released from either or both of bars 114, 115 so that the bars 114, 115 may be placed to either side of a pipe to be wrapped and shaft 117 may be reinstalled below the pipe without the necessity of running the apparatus over and end of the pipe. The shaft 117 is reconnected so that the shaft 117 and wheels 118 and 119 are disposed beneath the pipe as shown in FIG. 6. The angularity of bars 114, 115 is adjustable by adjustment of nuts 112 along a screw 123 which is supported by plate 124 from member 87. Collar 126 may be moved upwardly and downwardly along screw 123 in this manner. Collar 126 has a lug 127 to which link 128 is connected at pin 129, link 128 being pivotally connected to bar 114 at pin 130. The weight of ring 16, gear 15, and the spindles heretofore described located to the left of plate 101, and the tension of the tape being wound onto the pipe, is sufficient that lower wheels 118, 119 will remain in contact with the lower side of the pipe when the equipment is assembled upon a pipe. The drive assembly, as shown in FIG. 6, tends to rotate counterclockwise because of the weight of the equipment to the lefthand side of ring 19.

Member 87 has an upstanding portion **87*a* to which is affixed a horizontal handle rod 133 which may be used to control the rotational position of the apparatus upon the pipe. The apparatus tends to rotate about the pipe because of the rotational pull exerted by the tapes along tape courses 61. The wheels 109, 110 and 118, 119, being frictionally engaged with the pipe are quite resistive to this rotation, but at times the equipment may tend to rotate somewhat around the pipe and may be righted by the operator grasping handle shaft 133** and physically rotating the equipment properly back to the upright position with regard to the pipe.

A hose or conduit 135 conveys compressed air or other hydraulic fluid to pressure regulator 136. Conduits 137, 138 convey the hydraulic to hydraulic motors 140, 141. Conduit 138 is most conveniently in a form of a hose which is looped over the equipment so as to be out of the path of the pipe to be wrapped. Motor 140 has shaft 146 which carries sheave 147. Sheave 147 may instead be a chain sprocket. A belt is disposed around sheave 147 and a sheave 148 carrying gear 150 engaged with gear 151 on shaft 108. Thus, when motor 140 is operated, shaft 108 is rotated to rotate wheels 109, 110 which thereby propel the equipment along the pipe. Motor 140 may be a reversable motor so that the apparatus may be driven in either direction along the pipe. A gear 153 engaged with gear 15 is driven in rotation by hydraulic motor 141, gear box 154, belt 155 around sheaves 156, 157, and drive device 158. When motor 141 is operated, ring 16 is rotated around the pipe to be wrapped, carrying the tape spindles so that the pipe is wrapped in the manner heretofore described. It will be understood that the apparatus is adjustable for use on different size pipes by moving member 85 inwardly and outwardly by positioning of bolts 104 in different holes 107 of ring 101, and that the vertical spacings between wheels 109, 110 and 118, 119 may be adjusted by movement of collar 126 along threaded screw 123. These adjustments for different pipe size may be made rapidly without expenditure of excessive time and trouble.

A ring 116 may be affixed to ring 23 by bolting members 161 to ring 160 at their inner ends and to ring 23 at their outer ends, as shown. Ring 116 carries a fabric element 162 of L-shaped cross section surrounding the pipe. A tank 165 supported by bar members 166 connected to members 87, 88 has an outlet conduit 170 having valve 171 angularly disposed to terminate above the pipe adjacent ring 19. Tank 165 has filler opening 173 closed by a suitable cap by which the tank 165 may be filled with a liquid coating or priming material to be applied to the pipe. By proper adjustment of valve 171 as the apparatus moves along the pipe the pipe coating material is drained onto the pipe and is smeared by rotating member 162 to uniformly coat the pipe prior to application of the tape. With proper adjustment of valve 171, the proper amount of liquid for applying a uniform coating may be achieved. In this manner, the pipe may be coated or primed just prior to application of the tape wrapped around the pipe so that the complete taping job may be accomplished through use of the apparatus.

Ring 16 and gear 15 have a hinge 175 at one side and a releasable connection at the other side so that they may be placed around a pipe without having to be received over an end of the pipe. The hinge and release assemblies may be in the form of lapped plates bolted to half circle elements of ring 16 and gear 15.

Rings 19 and 160 are similarly provided with hinge and releasable connection assemblies 176 and 177 so that these elements may be assembled around the pipe without the necessity for inserting the apparatus over the end of the pipe.

An important advantage of the brake assemblies herein described is that they provide constant tape tension over the full length of a roll of tape. The brake disc 80 moves inwardly of plate member 45 as the roll diameter diminishes so that the torque of the withdrawn tape tension on plate 45 decreases closely proportionally to the decrease in braking torque, so that the tape tension remains virtually constant. Take-up spindle 49 rotates somewhat faster than is necessary to take up all of the backing stripped from the tape, and belt 63 slips sufficiently to correspond to the length of backing taken up on the spindle.

Motor 140 is an adjustable variable speed motor, and the lap or overlap of succeeding tape courses wrapped onto the pipe is controlled by adjusting its speed which adjusts the speed of travel of the carriage along the pipe. The angles of the tape spindles 46 automatically adjusts in accord with the speed of travel of the carriage.

The apparatus is very satisfactory and trouble free in operation. It may be lifted and placed upon a pipe by two or three workmen for apparatuses useful in applying tape to pipes of, for example, up to about twenty inches in diameter. For larger sizes of pipe, the apparatus may require use of a crane for lifting and assembly upon a pipe.

While preferred embodiments of the apparatus have been described and shown in the drawings, many modifications thereof may be made by a person skilled in the art without departing from the spirit of the invention, and it is intended to protect by Letters Patent all forms of the invention falling within the scope of the following claims.

I claim:

1. Pipe wrapping apparatus, comprising a tape spindle having a tubular spindle shaft, and a support shaft extending into said spindle shaft and pivotally connected to said spindle shaft at the center of the tape roll widths thereof whereby the angular position of said spindle shaft automatically adjusts in response to the tension of the tape as the tape is withdrawn from the tape roll to be wound onto a pipe.

2. The combination of claim 1, said support shaft having an opening therethrough within said spindle shaft, said spindle shaft having at least one pair of opposite wall openings alignable with said support shaft opening, and pin means disposed through said support shaft opening and a said pair of opposite wall openings of said spindle shaft.

3. The combination of claim 2, including a ring member supported for rotation whereby a said pipe may be received concentrically therethrough, said support shaft being supported by said ring member generally transversely of said ring member.

4. The combination of claim 3, said ring member having at least one angularly adjustable support member affixed thereto and a said support shaft depending from each said angularly adjustable support member.

5. The combination of claim 4, each said support member comprising a yoke pivotally connected to said ring member, and means for adjusting the angular position of said yoke.

6. The combination of claim 5, said means for adjusting the angular position of said yoke comprising a pair of screws having their ends bearing against said yoke and threadingly received through said ring member at opposite sides of the pivotal connection of said yoke to said ring member.

7. The combination of claim 6, said ring member including at least one bar means extending outwardly therefrom, a said yoke being pivotally connected to the outer end of each said bar means.

8. The combination of claim 7, including two said bar means oppositely outwardly disposed radially of said ring member.

9. The combination of claim 8, each said yoke having longitudinal bar means affixed thereto at a central portion of said longitudinal bar means whereby said longitudinal bar means is moved transversely when the angular position of said yoke is altered, said longitudinal bar means having tape backing take-up spindle means rotatively affixed thereto at one end and having brake means for frictionally restraining withdrawal of tape from the tape roll at the other end.

10. The combination of claim 9, including core means rotatably disposed around said spindle shaft, circular plate means fixed concentrically around the end of said core means adjacent the inner end of said spindle shaft, said core means being adapted to receive the central opening of a roll of tape thereover to support the roll of tape with the inner side of the roll of tape disposed against said circular plate means, said brake means being frictionally engaged with said circular plate means to restrain its rotation to restrain withdrawal of tape from the tape roll and thereby tensioning the tape as it is wrapped onto a pipe.

11. The combination of claim 10, said brake means being supported at one end of a brake bar pivotally connected to said other end of said longitudinal bar means.

12. The combination of claim 11, the frictional engagement of said brake means with said circular plate means being adjustable whereby the tension of the tape wrapped onto the pipe is adjustable.

13. The combination of claim 12, said brake means comprising a brake disc carried by said brake bar resiliently biased against a face of said circular plate means, and means for adjusting the pressure of said brake disc against said circular plate means.

14. The combination of claim 13, said brake disc engaging said circular plate means at the side of said circular plate means at which the tape roll is disposed, said brake bar having an offset bracket at its other end pivotally connected to said other end of said longitudinal bar means whereby said other end of said brake bar is disposed spaced from said other end of said longitudinal bar means at the side of said longitudinal bar means opposite the pipe.

15. The combination of claim 14, said brake disc being disposed past a radius of said circular plate means perpendicular to said brake bar from said other end of said brake bar and the direction of rotation of said circular plate means being toward said one end of said brake bar from said other end of said brake bar whereby rotation of said circular plate means tends to pivotally move said brake bar toward the center of said circular plate means whereby an intermediate point of said brake bar remains in contact with said tape roll as tape is unrolled therefrom to be wrapped onto the pipe and the diameter of the tape roll is progressively reduced.

16. The combination of claim 15, said tape backing take-up spindle means comprising a generally cylindrical shaft and means at one end thereof for rotating said shaft as said circular plate means and said core means are rotated in response to withdrawal of tape from the tape roll.

17. The combination of claim 16, said generally cylindrical shaft comprising a pair of hemicylindrical shafts connected to said rotating means at said one ends and being increasingly spaced toward their other ends, whereby backing rolled thereon is held by the angularity of said hemicylindrical shafts and may be released for removal by pressing said other ends of said hemicylindrical shafts together.

18. The combination of claim 17, said rotating means comprising a sheave, said circular plate means having a sheave groove around its outer periphery, and belt means engaging said sheave groove and sheave whereby said sheave is rotated when said circular plate means is rotated.

19. The combination of claim 18, said ring member being supported for rotation by plural rollers depending from a carriage, said carriage having upper wheel means for engaging the upper side of a pipe and having lower wheel means for engaging the lower side of the pipe at a greater distance from said ring member longitudinally of the pipe than said upper wheel means, whereby said ring member may be moved along the pipe as wrapping of the pipe proceeds.

20. The combination of claim 19, said ring member being rotatable by hand to cause wrapping of tape onto the pipe, said carriage being also movable along the pipe by hand as wrapping proceeds.

21. The combination of claim 19, including means supported by said carriage for driving said upper wheel means in rotation and means for driving said ring member in rotation.

22. The combination of claim 21, said carriage having a portion adjustable radially of said ring member and supporting said upper wheel means whereby said upper wheel means are adjustable toward and away from the axis of a pipe, said lower wheel means including means for adjusting their distance toward and away from the axis of the pipe, whereby the positions of said wheel means may be adjusted to engage pipes of different diameters while maintaining said ring member concentric with the pipe.

23. The combination of claim 22, said lower wheel means being disposed at the outer end of pivotal means pivotally connected to said adjustable carriage portion.

24. The combination of claim 23, said upper wheel means comprising an axially spaced pair of upper wheels and said lower wheel means comprising an axially spaced pair of lower wheels, the axial spacings of said upper and lower wheels being adjustable for engagement of said wheels with pipes of diverse diameters.

25. The combination of claim 24, said ring member having gear means therearound and said means for driving said ring member in rotation having gear means engaged therewith.

26. The combination of claim 25, said ring member being hinged at one side and having a releasable connection at another side, said carriage including means encircling the pipe which is hinged at one side and having a releasable connection at another side, said lower wheels being mounted on a removable shaft, whereby said apparatus may be installed on and removed from a pipe transversely of the pipe without access to an end thereof.

27. The combination of claim 26, including means supported by said carriage for depositing liquid material onto a pipe and including means disposed peripherally around the pipe and supported by said ring member for spreading said liquid material over the surface of the pipe prior to wrapping thereof.

28. The combination of claim 9, said tape backing take-up spindle means comprising a generally cylindrical shaft and means at one end thereof for rotating said shaft as said circular plate means and said core means are rotated in response to withdrawal of tape from the tape roll.

29. The combination of claim 28, said generally cylindrical shaft comprising a pair of hemicylindrical shafts connected to said rotating means at said one ends and being increasingly spaced toward their other ends, whereby backing rolled thereon is held by the angularity of said hemicylindrical shafts and may be released for removal by pressing said other ends of said hemicylindrical shafts together.

30. The combination of claim 29, said rotating means comprising a sheave, said circular plate means having a sheave groove around its outer periphery, and belt means engaging said sheave groove and sheave whereby said sheave is rotated when said circular plate means is rotated.

31. The combination of claim 30, said ring member being supported for rotation by plural rollers depending from a carriage, said carriage having upper wheel means for engaging the upper side of a pipe and having lower wheel means for engaging the lower side of the pipe at a greater distance from said ring member longitudinally of the pipe than said upper wheel means, whereby said ring member may be moved along the pipe as wrapping of the pipe proceeds.

32. The combination of claim 31, said ring member being rotatable by hand to cause wrapping of tape onto the pipe, said carriage being also movable along the pipe by hand as wrapping proceeds.

33. The combination of claim 9, said ring member being supported for rotation by plural rollers depending from a carriage, said carriage having upper wheel means for engaging the upper side of a pipe and having lower wheel means for engaging the lower side of the pipe at a greater distance from said ring member longitudinally of the pipe than said upper wheel means, whereby said ring member may be moved along the pipe as wrapping of the pipe proceeds.

34. The combination of claim 33, said ring member being rotatable by hand to cause wrapping of tape onto the pipe, said carriage being also movable along the pipe by hand as wrapping proceeds.

35. The combination of claim 34, including means supported by said carriage for driving said upper wheel means in rotation and means for driving said ring member in rotation.

36. The combination of claim 35, said carriage having a portion adjustable radially of said ring member and supporting said upper wheel means whereby said upper wheel means are adjustable toward and away from the axis of a pipe, said lower wheel means including means for adjusting their distance toward and away from the axis of the pipe, whereby the positions of said wheel means may be adjusted to engage pipes of different diameters while maintaining said ring member concentric with the pipe.

37. The combination of claim 36, said lower wheel means being disposed at the outer end of pivotal means pivotally connected to said adjustable carriage portion.

38. The combination of claim 37, said upper wheel means comprising an axially spaced pair of upper wheels and said lower wheel means comprising an axially spaced pair of lower wheels, the axial spacings of said upper and lower wheels being adjustable for engagement of said wheels with pipes of diverse diameters.

39. Pipe wrapping apparatus, comprising carriage means supportable for movement along a pipe, support means surrounding the pipe supported by said carriage means for rotation around the pipe, and tape spindle means supported by said support means being pivotally mounted centrally of the tape spindle means axis whereby the angularity of said tape spindle means is automatically adjusted by the tension of the tape being wrapped onto the pipe so that the tape is wound flatly onto the pipe without wrinkling and distortion.

40. The combination of claim 39, including brake means for restraining rotations of said tape spindle means for controlling the tension of tape wrapped onto the pipe.

41. The combination of claim 40, said brake means acting against enlarged circular end means of said spindle means.

42. The combination of claim 41, including take-up spindle means for taking up backing stripped from the tape as the tape is drawn from said tape spindle means.

43. The combination of claim 42, said take-up spindle means being rotated in response to rotations of said enlarged circular end means of said tape spindle means.

44. The combination of claim 43, said take-up spindle means comprising mutually angularly disposed hemicylindrical halves, the angularity of said halves retaining backing wound thereon, said halves being compressible together for removal of backing wound thereon.

45. The combination of claim 44, including means for moving said carriage means along a pipe and means for rotating said support means.

46. The combination of claim 45, said apparatus being installable onto and removable from a pipe without access to and end of the pipe.

47. The combination of claim 46, including means for applying liquid material onto the pipe before wrapping thereof.

* * * * *